US010435224B2

(12) United States Patent
Sines

(10) Patent No.: US 10,435,224 B2
(45) Date of Patent: Oct. 8, 2019

(54) DOME FORMATION PROFILE AND METHOD OF LIGHTWEIGHT CONTAINER DESIGN AND MANUFACTURE

(71) Applicant: Can Forming Technologies, LLC, Broomfield, CO (US)

(72) Inventor: James Alan Sines, Broomfield, CO (US)

(73) Assignee: CAN FORMING TECHNOLOGIES, LLC, Broomfield, CO (US)

( * ) Notice: Subject to any disclaimer, the term of this patent is extended or adjusted under 35 U.S.C. 154(b) by 0 days.

(21) Appl. No.: 15/985,420

(22) Filed: May 21, 2018

(65) Prior Publication Data

US 2019/0055074 A1 Feb. 21, 2019

Related U.S. Application Data

(63) Continuation-in-part of application No. PCT/US2018/028751, filed on Apr. 21, 2018.
(Continued)

(51) Int. Cl.
*B65D 1/00* (2006.01)
*B65D 79/00* (2006.01)
(Continued)

(52) U.S. Cl.
CPC ..... *B65D 79/005* (2013.01); *B65D 1/0276* (2013.01); *B65D 1/165* (2013.01); *B65D 1/46* (2013.01); *B65D 23/001* (2013.01)

(58) Field of Classification Search
CPC ..... B65D 79/005; B65D 1/0276; B65D 1/46
(Continued)

(56) References Cited

U.S. PATENT DOCUMENTS 77,280 A * 4/1868 Hadden ..... B65D 7/36 220/623
204,971 A * 6/1878 Hill ..... B65D 7/36 220/623

(Continued)

FOREIGN PATENT DOCUMENTS

EP 1127795 A2 8/2001
EP 1332971 A1 8/2003
EP 1725354 B1 12/2012

OTHER PUBLICATIONS

International Search Report and Written Opinion dated Jul. 13, 2018 in International Application No. PCT/US18/28751.

*Primary Examiner* — Ernesto A Grano
(74) *Attorney, Agent, or Firm* — Berg Hill Greenleaf Ruscitti LLP.

(57) ABSTRACT

The inventive technology includes a novel container dome profile and manufacturing process for improving container and bottle deformation failure resistance and extending material displacement modes through an initial deformation panel coordinated with complimentary geometric paneling and buttressing structures configured to initiate a controlled sequential dome profile deformation mode. Dome reversal, dome growth, and dome drop resistance characteristics are improved with a shallower profile formation depth, reducing pulldown, and lowering material consumption, resulting in lower overall container/bottle weight. Novel geometric contoured shapes enhance container resistance performance, supporting use of softer alloys or lower temper and yield strength to benefit post-processing efficiency and forming processes improvements while being configured to initiate controlled sequential dome profile deformation.

30 Claims, 9 Drawing Sheets

Related U.S. Application Data

(60) Provisional application No. 62/488,125, filed on Apr. 21, 2017.

(51) Int. Cl.
*B65D 1/02* (2006.01)
*B65D 1/16* (2006.01)
*B65D 1/46* (2006.01)
*B65D 23/00* (2006.01)

(58) Field of Classification Search
USPC ..... 215/381; 220/606
See application file for complete search history.

(56) References Cited

U.S. PATENT DOCUMENTS 3,905,507 A 9/1975 Lyu
3,979,009 A 9/1976 Walker
4,108,324 A 8/1978 Krishnakumar et al.
4,147,271 A * 4/1979 Yamaguchi ..... B65D 1/165 220/606
4,598,831 A 7/1986 Nakamura et al.
4,732,292 A * 3/1988 Supik ..... B65D 1/165 220/604
4,953,738 A * 9/1990 Stirbis ..... B65D 1/165 220/606
5,119,962 A * 6/1992 Vercillo ..... B65D 79/005 215/230
5,593,063 A * 1/1997 Claydon ..... B65D 79/005 220/608
5,626,228 A * 5/1997 Wiemann ..... B65D 1/26 206/511
5,727,710 A * 3/1998 Severus ..... B65D 79/005 220/609
6,098,832 A 8/2000 Jentzsch et al.
6,131,761 A 10/2000 Cheng et al.
6,220,073 B1 4/2001 Cheng et al.
6,293,422 B1 * 9/2001 Jentzsch ..... B65D 7/04 220/606
6,296,139 B1 10/2001 Hanafusa et al.
6,634,517 B2 10/2003 Cheng et al.
7,185,525 B2 * 3/2007 Werth ..... B65D 7/46 72/348
2004/0000533 A1 * 1/2004 Kamineni ..... B65D 1/0276 215/373
2008/0029523 A1 * 2/2008 Tung ..... B65D 1/165 220/608
2009/0308835 A1 12/2009 Boukobza
2011/0204067 A1 * 8/2011 Schneider ..... B29C 49/541 220/606
2016/0176605 A1 6/2016 Pritchett et al.
2016/0311599 A1 10/2016 Stelzer et al.
2018/0327130 A1 * 11/2018 Taruno ..... B65D 23/02

* cited by examiner

DOME FORMATION PROFILE AND METHOD OF LIGHTWEIGHT CONTAINER DESIGN AND MANUFACTURE

CROSS REFERENCE TO RELATED APPLICATIONS

This application is a bypass continuation-in-part application under 35 U.S.C. 371 and claims the benefit of PCT Application No. PCT/US18/28751, having an international filing date of Apr. 21, 2018, which designated the United States, which PCT application claimed the benefit of U.S. Patent Application No. 62/488,125, filed Apr. 21, 2017, the disclosure of each of which are incorporated herein by reference.

TECHNICAL FIELD

The present invention relates to a light-weight metallic container having a novel dome profile configured to reduce pulldown or the volume of metal consumed by the dome profile, and methods of manufacturing the same. In other embodiments, present invention relates to a light-weight metallic container having a novel dome profile configured to reduce dome depth, and methods of manufacturing the same. In other embodiments, present invention relates to a light-weight metallic container having a novel dome profile configured to increase dome reversal performance, and methods of manufacturing the same. In one preferred embodiment, present invention relates to a light-weight container having a dome profile configured with a centrally positioned initial deformation panel coupled with a network of buttressing structures configured to initiate a controlled sequential dome profile deformation mode, and methods of manufacturing the same.

BACKGROUND OF THE INVENTION

Nearly 300 billion food and beverage containers, bottles and preforms are manufactured worldwide each calendar year. These containers are primarily produced from aluminum but may also be produced from other materials such as steel and other alloys. The material consumed in the production of each container becomes a primary cost of manufacturing. It is common that the material cost comprises more than 30% of total manufacturing cost of each container. Material cost(s) often fluctuate due to market prices resulting in significant changes to profitability for all container manufacturers. The material consumption or the efficiency of material utilization is critical to total product quality performance and realized cost of manufacture. The average container weight of existing art has reached a plateau since 2007, with only 2-5% weight reductions on average being achieved. Prevailing art has reached physical limitations of weight reduction while adhering to the required field container structural performance metrics.

Light-weight metal containers, including metal food or beverage containers and bottle preforms are manufactured in an ironing press or metal forming process resulting in an elongated volumetric cylinder of a shaped metallic container body, preform or bottle or metallic hollow body. The apparatus being generally known in the art as "bodymakers" or "wall ironers" have been traditionally utilized to form these metallic cylinders. Specifically, such metal containers are formed from a base material thickness or coiled sheet. Such containers typically consist of an ironed, or reduced contoured wall which forms a thinwall cylinder, and a contoured base or bottom defined as a "dome profile." The formation of the dome profile results in a shaped geometric contour formed in a domer mechanism during the completion of the machine stroke. The base profile geometries are formed at the end of a single machine stroke resulting in an individual container being produced with each full stroke of the bodymaker. The domer mechanism utilizes known tooling art commonly entitled as "inner domer die" i.e., "domer post" and the "outer domer die" or i.e., "clamp ring," to form the base profile geometries. These tools are used to contour form the base profile geometries in standard base formations for the industry.

In general, traditional base profiles utilized in the art consist of a contoured geometric profile shape which is often referred to as a "dolphin nose" contour forming the base profile of the container, and is primarily used to provide the subject container "stackability." As used herein, the term stackability generally refers to the aspect of fitment with the container base and the container lid as a container may be stacked upon another—such that they may be stored on store shelves or presented within the beverage and food markets as stacked items.

The geometric contour of the base profile is most often divided into two primary shaped regions of an outer base profile and an inner base profile. These contour profiles are normally bisected by the base nose or otherwise defined as the stand diameter. The base nose diameter primarily defines the stackability and is commonly known in the art as the "stand diameter." Common industry stand diameters are sized as 200, 202, 204, 206, 209 and 300 and the like. For example, a 200 stand diameter correlates to a 2" base profile. These base sizes are commonly sized by 1/16" of an inch correlated increments, such that 202 is 2-2/16 or 2⅛" base diameter. Correspondingly, 206 equals 2 6/16" or 2⅜" and 300 equal 3.00". These common industry standards define the amount of diametral material to be consumed in the inner base dome profile formation by the analogous size. It should be noted that the novel dome geometries can be formed and applied to any commercial base size.

Traditional metal containers provide an inner base contour consisting of these industry standard diametral sizes producing specific geometric profiles for each correlated base size. The inner contour originates from the stand diameter with an inwardly protruding domed contour of convex shape culminating in a crowned spheroidal shaped radial contour. This domed contour is most commonly comprised of distinct combinations of bi-radial segments and symmetrical radial contours, or a centrally formed singular spheroidal shape commonly referred to as the "inner dome" profile. Traditional dome profiles also typically standardize specific dome depth of inwardly formed protrusion, normally between about 0.37-0.50 inches.

One major limitation of these traditional dome profile designs is that they require a minimum depth of the domed structure to produce adequate strength required to fulfill the minimum internal pressure resistance strength of approximately 70-100 psi (pounds per square inch). Naturally, container minimum internal pressure resistance strength may vary by specific product requirements. The dome profile's performance strength directly correlates to increasing the internal pressure resistance as the dome depth is increased. Subsequently, a corresponding minimum dome depth is required to fulfill industry standard quality performance metrics for each dome design size. Each dome profile family of base design performance is correlated to the minimum depth of the inner dome formation resulting in a specific minimum amount of material consumed. Consequently, traditional dome profiles known in the art are severely constrained as they require a minimum depth that ultimately limits the material savings threshold potential dictated by the performance metrics. Congruently, increasing the material consumption of metal volume absorbed in the dome profile geometry is invariably a direct result of an increased dome depth. Accordingly, it will be shown the novel invention included herein resolves both problems of increased material consumption, and base profile dome strength performance constraints.

The foregoing problems regarding dome profile design and manufacturing may represent a long-felt need for an effective—and economical—solution to the same. While implementing elements may have been available, actual attempts to meet this need may have been lacking to some degree. This may have been due to a failure of those having ordinary skill in the art to fully appreciate or understand the nature of the problems and challenges involved. As a result of this lack of understanding, attempts to meet these long-felt needs may have failed to effectively solve one or more of the problems or challenges here identified. These attempts may even have led away from the technical directions taken by the present inventive technology and may even result in the achievements of the present inventive technology being considered, to some degree, an unexpected result of the approach taken by some in the field.

As will be discussed in more detail below, the current inventive technology overcomes the limitations of traditional dome profile designs and manufacturing methods. In particular, embodiments disclosed herein demonstrate a novel dome profile structure resulting in decreased material consumption and volume, with increased strength through unique geometric formations improving resistance to failure, all while maintaining ease of manufacture, resulting in substantial container weight savings. The unique geometric features result in a base profile realizing significant material savings from the disclosures herein.

BRIEF SUMMARY OF THE INVENTION

One aim of the current inventive technology may include the design and manufacture of an improved dome profile design. In a certain embodiment, this novel dome profile improves the inner dome profile failure mechanical and structural modes such that performance failure is improved at a reduced inner dome depth. In this embodiment, the reduced inner dome depth, may allow a reduction of penetration depth of inner dome profile tools resulting in a reduced material consumption.

Another aim of the current inventive technology may include the design and manufacture of an improved dome profile that may be configured to reduce the "pulldown" consumption required by the inner dome formation. In this embodiment, the dome profile may achieve performance reversal failure targets while consuming much less material. This novel dome profile may also be configured to have improved failure resistance such that the starting gauge of, for example, a metal canister such as an aluminum can, or other metallic hollow body, may also be reduced. A lower starting gauge directly reduces the container or bottle weight and decreases overall material costs. For example in certain embodiments, the lightweight dome profile's ability to initiate a controlled sequential dome profile deformation may allow it to be manufactured from a metal having a gauge less than that of a comparable container wherein the lightweight dome profile has approximately equivalent deformation resistance as the comparable container. For example, in one preferred embodiment the starting gauge for 12 oz liquid container may be less than 0.0106", while in other embodiments the starting gauge for a 24 oz liquid container may be less than 0.0140". Such examples are non-limiting, and other starting gauges and their corresponding sizes and volumetric capacities are known by those of ordinary skill in the art.

Another aim of the current invention may include a novel lightweight dome profile configured to maintain, for example, industry standards and customer requirements for resistance to failure from application of a deformation energy while utilizing softer material alloy compositions. In some embodiment, this novel dome profile may enable the use of softer material alloy compositions, or starting yield strength to be reduced, resulting in improved container and dome profile formation processes. Notably, it should be understood by those skilled in the art that container dome profile performance characteristics, and resistance to failure are improved as the alloy yield strength is increased. However, as the yield strength is increased the formability and manufacturing efficiency decreases inversely due to the materials' hardness and resistance to forming processes. Stronger materials are harder to form at higher rates of speed and efficiency, and inversely softer materials are easier to form—yet have lower structural resistance performance. However, using softer alloys with lower yield strength provides additional benefits to the metal forming and ironing processes with increased operational latitude. The softer alloy compositions and softer tempering of coil materials improves the formability at higher efficiency of production rates with lower defects and scrap. In general, softer alloys enjoy improved metal forming process efficiencies as well unit throughput, and lower defect rates. As such, the ability to generate an improved dome profile using softer alloys as described herein allows all of the advantages outlined above to be captured by the current inventive technology.

Another aim of the invention is to design and/or manufacture one or more novel dome profiles that improve secondary processing, such as necking or various formation processes of the neck or thread profiles. With these improvements captured by one or more novel dome designs, alloy temper, yield strength and chemistry can be modified toward a better performing recipe resulting in improved formation as well as easier and more efficient container and bottle preform manufacturing. These processes are generally improved by the material enhancement of formability as well as the reduced number of defects, such as pleats or puckers, during the neck and bottle formation processes. The dome profile embodiments described herein enable the use of lower alloy yield strength materials, directly improving manufacturability, and total production efficiency of the entire manufacturing process for container and bottle production. Another aim of the invention is to design and/or manufacture one or more novel dome profiles that reduce the material consumed in the body or circumference of the container or bottle preform. The ability of such preferred dome profile embodiments to lower the depth of the dome profile results in an increased internal volume of the container. This volume of specific container and bottle sizes are typically standardized in the industry for actual volumetric serving sizes. Containers and bottle are often sized for fluids of: 8 oz, 12 oz, 16 oz, 100 ml, 150 ml, 250 ml, 33 cl, 50 cl, 24 oz, etc., such that these various volumes of fluid are designated commercially to be within the specified container or bottle. As such, the lower dome depth achieved by the novel dome profile disclosed herein, facilities the volumetric change of the internal capacitance which may be adjusted such that the body diameter may now be reduced. Certain dome profile embodiments may reduce the material consumed in the cylinder, or the circumferential body shape of the container perimeter without reducing the failure resistance or material thickness of container walls. Lightweight dome profile embodiments reduce the container weight and metal consumed for the same volumetric containment while not decreasing failure resistance performance characteristics. Additional dome profile embodiments may reduce the material requirements by the volumetric change of the container enabling the dome profiles disclosed herein to support downgauging, or using lower starting gauges, which result in significant financial savings when applied to various container and bottle designs.

Yet another aim of the invention may include one or more light-weight metallic container having a dome profile configured with a centrally positioned initial deformation panel coupled with a plurality of buttressing structures configured to initiate a controlled sequential dome profile deformation, and methods of manufacturing the same. In one preferred embodiment, one or more geometric panels may be interlaced with one or more buttressing structures which may be further coupled with an initial deformation panel through a deformation panel boundary and configured such that they provide laterally formed regions increasing the structural displacement resistance of the dome formation for drop performance. Existing art is limited in container drop resistance performance due to the depth of the spherical dome shape of the inner panel and the dome reforming processing. Those skilled in the art understand that increasing depth of the dome profile formation also improves the drop resistance. However, there is a limit to the depth achievable as it increases the risk of fracture and failure in the metal formation processes.

Another aim of the invention may include a profile configured to have improved drop performance. In a preferred embodiment, drop performance may be improved by the novel incorporation of a controlled sequential dome profile deformation configuration or geometric regions, which allow certain portions of the dome profile to fail prior to the full base profile reversal failure. As detailed below, in one embodiment, the geometric contoured shapes may be coordinated and/or coupled with an initial deformation panel, which may be configured to begin to fail prior to the entire dome profile reversal failure.

Another aim of the invention may include a dome profile configured to have improved force intensity absorption potential resulting in an increase in the length of time of abuse the dome profile observes. In one preferred embodiment, a dome profile disclosed herein may increase the overall fatigue and failure resistance of desired abuse resistance by facilitating a multi-staged or sequential failure of the dome profile. Prior art demonstrates severe limitations due to the single failure mode which is linear, or non-sequential, commonly resulting in full reversal failure. It should be noted that the terms failure, reversal, or full reversal failure may generally describe the deformation of a container dome profile where the inner dome profile is deformed to be past or below the bearing surface of a canister's bottom structure. In certain other embodiments, the terms failure, reversal, or full reversal failure may generally describe the loss of the structural integrity of a dome profile's inner leg, or collapse or alteration of the inner conical leg angle resulting dome profile deformation. For example, during a dome reversal failure, the profiled geometry of a traditional spherical dome continues to weaken in a linear fashion, reducing the resistance force capacity of the dome profile until eventual and complete reversal failure of the dome profile geometry occurs as detailed below and shown in FIG. 1.

One aim of the invention may include the design and generation of a dome profile that incorporates novel structural failure regions of specific integral geometric panels, boundaries and buttressing formations that may be configured to extend the failure mode time and structural reversal deflections in a sequentially controlled manner. Such dome profile embodiments support a staged reduction of the internal pressure of the dome profile throughout the failure mode sequencing such that relaxation of internal pressure occurs during the entire length of the failure mode(s). The novel dome profile disclosed herein controls the stages of mechanical displacement such that the total abuse resistance, the time required to failure and internal structural resistance of the profile, is improved during the dome reversal failure mode(s). The unique embodiments of the dome profile geometric contoured shapes synergistically combine during displacement to increase the abuse resistance throughout the failure mode of the dome profile during all stages, resulting in an increased structural failure resistance without the requirement of reform or reshaping of base profile formation processes.

Another aim of the invention may include the design and generation of a dome profile having improved the performance characteristics, and in particular, dome profile resistance during pasteurization. The use of pasteurization requires the container or bottle to be filled with fluid or fluid type ingredients to be processed in a heated fashion such that internal temperatures reach a desired pasteurization level. Pasteurization causes the internal pressure of a container to increase, resulting in a significant rise of internal container pressure which normally produces a height increase of the dome profile resulting in growth distortion from the pressure—or a change in container height. Upon cooling, the container and contents may be returned toward original specific volumes and product density. Specifically, at room temperature the containers or bottle may not return to their near original heights and geometries. This process introduces variation in dome growth resulting in heights of varied base profile changes and abnormalities in height response due to the pasteurization processing. This creates significant problems for packaging and distribution as filled can heights may vary significantly. In one preferred embodiment, a novel base profile having one or more geometric contoured shapes may be configured to control the growth through a controlled sequential dome profile deformation, thereby reducing final deformation, such as height changes or dome growth. In this embodiment, the dome profile may exhibit a higher resistance to deformation of radial or designed regional geometries. In this manner, the dome profile may continue to increase the resistance by using the energy of the deformation movements of centrally focused movements, with adjacent geometric contoured shapes, such as an initial deformation panel coupled with one or more buttressing structures and geometric panels, through in some embodiments a geometric panel may be used. Such integral structures may be configured to synergistically network together to reduce the permanent deformation of the base profile through active energy absorbing crumple and compression zones within the geometric contoured shapes. This dome profile embodiment provides an increase in deformation resistance through active buttressing structures or geometries of the base profile. Importantly, in this embodiment, the dome profile geometric contoured shapes may increase the failure resistance without requiring post-processing, or reforming to maintain the industry performance requirements of dome growth.

Another specific aim of the invention may include the design and generation of a novel dome profile that has reduced dome depth which may, in-turn, improve formability and manufacturability of the container or bottle production in the metal forming presses. The reduced dome depth decreases the length of time and distance required for dome formation as well as the penetration of the punch movement into the domer and domer tooling. Existing art requires substantial forming distance and time to clamp and produce the dome profile. Those skilled in the art commonly need about 0.40-0.50 inches or more of tool penetration to form existing art dome profiles. The distance required causes specific production problems of containers being stuck or trapped into the domer during high speed manufacture. This production speed limitation is eliminated as the reduced dome profile depth significantly reduces the required formation depth, improving manufacturability and resulting in an increased speed of production. Certain embodiments of the dome profile allow the formation in approximately half of the penetration, such that production speeds and efficiencies improve at much lower profile depths as described. Moreover, forming processes of container and bottle or preforms not disclosed as drawn & iron process, may also benefit and utilize the novel embodiments of the unique profile design enclosed.

Another aim of the current invention may include the design and generation of a novel dome profile that eliminates the need to post processing applications to the container, and in particular dome profile. Generally, these post-forming applications involve re-processing the geometry and may vary slightly by profile design. Generally, containers having a dome profile undergo a secondary process of reforming or re-shaping the inner dome profile. This reforming and/or reshaping processing is required to increase the structural reversal resistance, dome growth and drop resistance of the traditional dome profiles of traditional containers known in the art and bottles to meet minimum industry structural quality performance requirements for lighter gauges less than about 0.0106 inches or below for an exemplary 211 can size.

Another aim of the current invention may include the design and generation of a novel dome profile that has improved performance characteristics as generally understood by industry metrics. In a preferred embodiment, the invention may include a dome profile that may have improved resistance to structural dome reversal ("burst pressure"), drop resistance and dome growth. Generally, industry standards for structural metrics of dome profile quality performance characteristics are established by the filling customer processing requirements of the filling machinery, the fluid and/or gasses contained, and the shipping abuse resistance requirements. These quality metrics are generally characterized by structural dome reversal ("burst pressure"), drop resistance and dome growth respectively. For example, the industry minimum reversal pressure is generally about 90 psi as required for carbonated beverages and juice options, while about 93 psi as required for beer or other pasteurized fluids. The drop resistance performance is an abuse measurement of the dome profile failure with filled product as the base is impacted in a free fall due to gravity, striking a hard surface—such as a floor. The existing industry specifications of this abuse resistance test requires the container to be filled with fluid product under an internal pressure and then dropped repeatedly, at increasing height intervals onto a hard surface or metal plate until complete dome reversal, fracture or failure/rupture occurs.

It should be noted that there are slight regional/hemispheric differences around the world for this minimum abuse requirement due to customer drop specifications primarily considering variation of distribution damage, related to the quality of roads, transportation and storage infrastructure, and varying environmental conditionals. Each of these conditions may alter established abuse resistance requirements of a particular region. For instance, railway shipments of filled product can be more abusive than "air ride" equipped truck short haul or semi-trailer truck transportation. Additional factors such as the distance of transport, and/or fluid density variations all contribute toward impacts of specific base profile drop reversal resistance requirements. Additional considerations may include difference in ambient air temperature in certain regions where manufacturers and customers may require higher structural resistance specifications for containers, for example, that may be stored in extremely hot or cold conditions and the like. The novel embodiments of the dome profile may improve the dome drop resistance through controlled, sequenced and structural failure modes utilizing the deformation energy and displacement to increase geometric buttressing of networked geometric panels and geometric structures to absorb greater impact energy, resulting in an increased drop resistance of lighter gauge and lower strength alloys.

As noted above, traditional dome profiles require the post-processing of the inner dome profile. In particular, traditional dome profiles often must be reformed and reshaped primarily to improve the container reversal resistance due to the geometric buckling and structural reversal of the inner dome profile geometry and, more specifically, the spherical radius reversal. The reforming process is also used to counteract dome growth due to pasteurization in traditional dome profiles, although the reform process inversely reduces drop failure performance. This process is defined in existing art as "dome reforming" process, generally embodied in U.S. Pat. Nos. 5,355,709, and 6,098,832, respectively, each of which is incorporated herein in their entirety by reference.

As noted in the prior art incorporated by reference above, the dome profile reforming process creates an internal bead geometry shaped as a deformed radius profile onto the inner leg length of a traditional dome profile. Introducing this shaped "bead" consumes metal geometrically from the inner dome profile as it is formed or added post formation in the bodymaker domer. The dome profile was previously formed in the bodymaker and domer at a deeper protrusion due to this material consumption, known as "squatting." Therefore, the reforming process of the added bead ring shape increases the material usage of the profile geometry for reversal resistance. The reform process requires an inherently deeper dome to be formed previously, which directly adds to the container weight, and resultant material consumed. The novel dome profile(s) described herein eliminates the need for a dome profile reforming process, generating significant cost saving in material and manufacturing process, as well as obviating the structural limitation imposed during the reforming process as outlined above.

Another advantage achieved by the invention may include the elimination of "dome squatting" that may occur in reforming or other post-processing application. The effect of what is known as "dome squatting" occurs in the inner spherical radius as it is lowered from its original height due to the bead depth of diametric penetration created in post-reforming process. Consistently, a profile dome's "squat" is proportional to as much as 50% or more of the starting gauge thickness due to the bead penetration of the reform process. This action and process of reforming consumes more material as well through resultant "dome squatting." The reaction of this secondary forming process of reforming pulls in the dome-radius towards a flattened radial shape which resultantly lowers the dome depth and increases fill volume. The geometric material consumption of reforming the dome profile in this area consumes material from the starting metal gauge, and therefore is adding to the material consumed in higher weights of material from this process combining with other related factors of dome profiling material consumption such as 'pulldown.' As such, the novel embodiment of the lightweight dome profile eliminates the need of reforming or any post-processing such that this material consumption may be conserved and/or eliminated entirely.

Additionally, the reformed bead diameter of this secondary process directly increases the dome reversal performance of the spherical profile formation by deforming the inner leg to improve resistance of unwrapping or unraveling failure mode due to the buckling failure sequences of the dome profile displacement of the geometric profile. The actions of traditional dome profile geometry during the dome reversal are represented by an unraveling of the profiled geometries, so that the beaded deformed area creates a higher physical resistance barrier toward the unraveling sequence as there is a greater resistance to unrolling within the geometry of the beaded formation. This improved failure action of the reform bead directly increases the reversal or burst pressure resistance while also slightly increasing the failure mode time. The beaded geometry and additional material consumed by the final bead depth or final bead diameter is correlated for specific starting metal gauges, dome profiles and various failure resistance characteristics to result in achievable minimum burst pressure performance, while maximizing the inversely related dome growth performance. The novel dome profile embodiment of the invention creates an increased reversal resistance and burst pressure performance by unique incorporation of networked geometric contoured shapes, such as an initial deformation panel having a boundary that may be synergistically coupled with one or more buttressing structures and geometric panels, which eliminate any requirement for post-processing of dome reforming or reshaping, resulting in significantly lower starting metal consumption volumes and higher structural performance. As detailed below, or shown in the figures, such coupling and or synergistic networking of elements may be integral or non-integral in nature depending on the desired application. In certain embodiments, the term integral coupling may indicate a coordinated relationship such that the coupled components may form a coordinated network and may be physically linked and moreover may synergistically act in response, for example, to a deformation force.

Additionally, the inner dome reforming process also has other characteristics which create specific limitations to the drop resistance performance of traditional dome profiles. For example, the container forming industry is generally standardized around prior art that requires these post-processing methods of dome profile performance strengthening through reforming and reshaping processes which require a minimum dome depth of adequate penetration length necessary to physically confine the reform tooling and enable the geometric deformation of the inner dome leg profile. Therefore, prior art must be of sufficient dome depth such that the inner leg length minimum is required to accept a beading tool geometrically, and therefore inherently consumes more starting materials—resulting in higher can weights. For example, increasing the bead depth has a limitation of bead penetration ratio which directly degrades the drop performance. The inner dome profile performance is improved as the bead is presented to the inner leg, but has a specific penetration limit that once breached, drastically reduces performance of drop failure resistance. Often the bead depth beyond more than twice the starting gauge results in the reform process actually reduces the drop resistance inversely. Conversely, too shallow of a bead does not satisfy the reversal structural requirements and growth targets. Tightly controlled management of the profile geometry is required or containers will not meet the quality performance metrics of concern to customers/fillers. The container performance characteristic of the inner dome profile specific to drop performance is inversely reduced as the reform bead depth is increased. There is a critical combination of bead penetration vs. starting gauge and material consumption required for optimal failure resistance performance of all quality metrics for current art.

The novel embodiments of this inventive dome profile(s) generally described herein, eliminate the post-processing requirements of reform or reshaping the dome profile for improved failure resistance, eliminating the above costs and technical considerations. The novel geometric contoured shapes are configured to initiate a controlled sequential dome profile deformation providing sufficient minimum reversal performance requirements resulting in the lower material consumption, reduced starting gauges and ability to utilize lower hardness or lower tempered alloy metals of lower yield strength.

As detailed below, one aim of the invention may include a dome profile design, and methods of manufacturing the same, having technical geometric contoured shapes that may result in an improved lightweight container design with improved manufacturing efficiencies of combined structural enhancements, reduced costs and lower material consumption. Such a novel dome profile includes the strategic placement and orientation of geometric contoured shapes in a designed network resulting in significantly improved reversal strength and failure resistance. The designed network and structured geometric contoured shapes or features may act synergistically in some cases to improve the inner dome profile strength during displacement and movement of adjacent features. The leveraged action of the geometric displacements of the paneled deflection features may combine during deformation to strengthen one or more buttressing structures.

In this manner, one aim of the invention includes a novel dome profile designed to undergo a controlled, sequential and/or strategic coordinated networked deformation while resulting in an increase in the overall structural resistance of the dome profile during failure. The dome profile's unique geometric contoured shapes may utilize the mechanical deformation of the specific geometric panel or zones to focus the articulation of 'a network' of symmetrical radial features radial legs combining with unique panel zones displacing into the buttressing features, utilizing this physical energy of deformation in a structurally reinforcing network sequenced impedance against physical failure modes. The deformations are networked to combine in such a sequence to extend the time and physical energy of displacement focusing absorption of energy within adjacent buttressing features. The displacement time, in relation to the dome profile failure is lengthened as the deformation energy is absorbed in a sequential manner, through, for example a coordinated network of related features.

As detailed below, the increased structural failure resistance demonstrates the controlled sequentially networked dome profile deformation modes of dome profile structural deformations such that displacement energy and strain energy converge with buttressing structures in a sequential and structurally complimentary network action creating higher physical resistance and performance of the dome profile to package quality structural requirements of dome reversal, dome drop and dome growth physical characteristics. These geometries and features cohesively combine displacement energies of geometric deformations into physical network of reinforcing geometries resulting in reduced starting material volume requirements with significant material weight savings. Moreover, as shown below, structural integrity improvements of the novel dome profile geometric network facilitates the ability to manufacture associated container and bottle products from softer and/or lower temper alloy metals with lower yield strength options resulting in higher outputs of container manufacturing and improved post processing formability, quality and manufacturing efficiencies of related metal formation processes.

It is noted that the examples shown and described are provided for purposes of illustration and are not intended to be limiting. Still other examples are also contemplated and may be shown in the detailed description and figures outline below.

BRIEF DESCRIPTION OF THE FIGURES

As further shown, the geometric contoured shapes use the deformations of material in a complimentary manner during the focused displacement of the geometric features. Moreover, the dome profile deformations are focused in a controlled geometric displacement by the design and shape of geometric features eliminating irregularities of force absorption. As shown in FIG. 2, the novel features of the invention provide benefits during a controlled sequential dome profile deformation sequence where the geometric contoured shapes may be utilized to focus the material deformation, for example, as would occur during dome failure or reversal deformation, resulting in force isolation in a complimentary manner. In this manner, the geometric contoured shapes of the inner profile mechanically utilize the material movements and deformations improving the inner dome profile strength as well as delaying the deformation phases by delaying the time of complete dome failure.

MODE(S) FOR CARRYING OUT THE INVENTION(S)

The present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Figure 1:
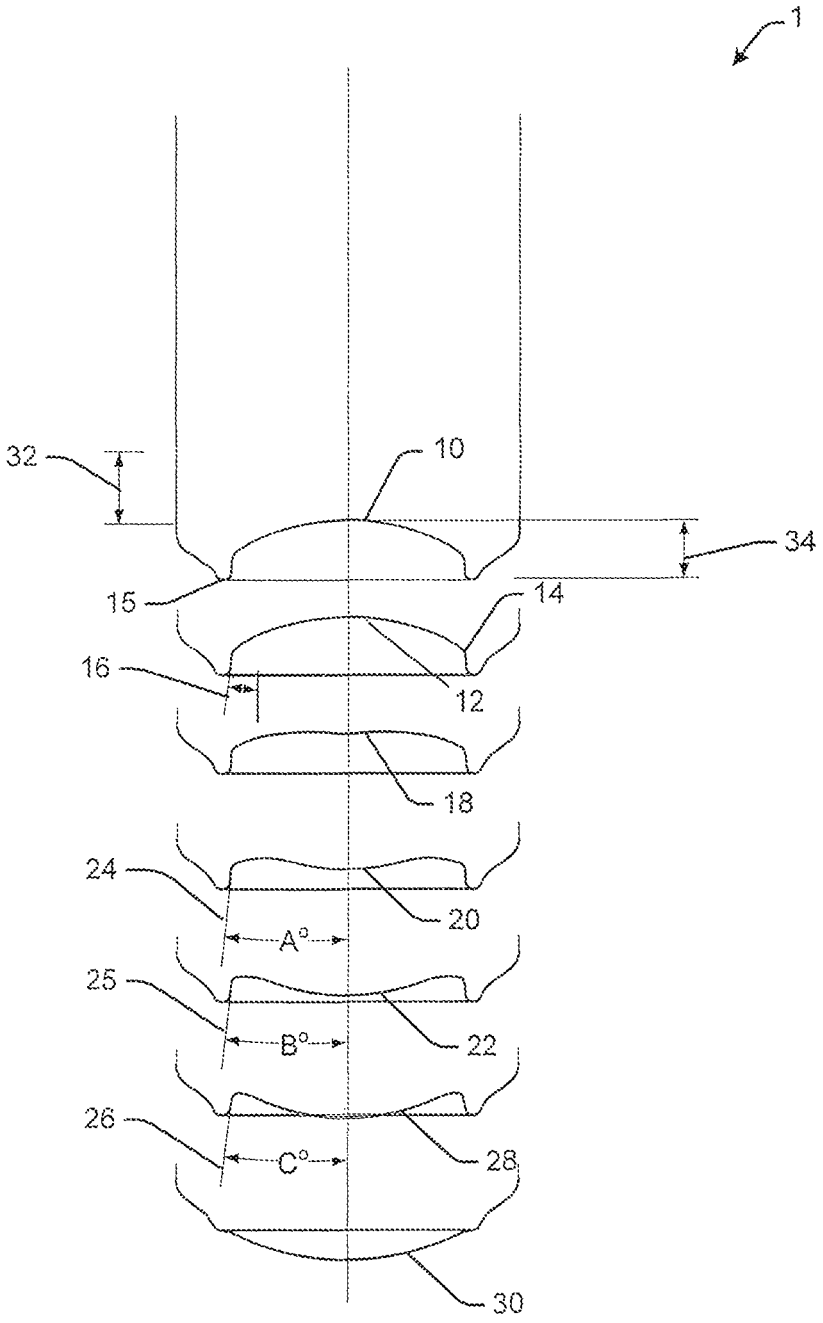
Prior Art FIGURE 1
FIG. 1: illustrates a typical prior art container base profile of 211 can diameter with a 202 base size undergoing typical failure sequencing through complete reversal deformation. The standard progressive deterioration of the dome profile induced by excessive internal pressure is generally shown. The dome profile absorbs the internal pressure to a point of collapse resulting in a complete reversal of the convex domed contour. The reversal of the domed geometry is the defined structural failure resulting in loss of product stackability and often loss of internal pressure. These failure defects render the container quality non-usable or non-conforming to designed container performance.

Generally referring to FIG. 1, a container (1) is shown having a traditional dome profile (10), in this instance for a metal can of a standardized material volume and weight is shown. This traditional dome profile (10) exhibits a inner dome profile (12) that is common within the industry. This inner or spherical dome profile (12) includes an inward protrusion of bi-radial tangent radii, or a unified blend of tangential spherical radii. The inner dome profile nose (14) radius torus has consistently been sized specifically for minimum reversal strength and sprayability between 0.050"–0.130". Smaller inner dome profile nose (14) radii may be structurally stronger but harder to spray and more fracture prone during formation processes. Traditional inner dome profiles also typically include a circumferentially tangent dome wall angle I (16). This angle is traditionally between 2-10°, or 0-15° degrees of taper, being tangent to the inner dome profile nose (14) and the punch nose radius (15). The inner dome profile (12) initial inner dome reversal I (18) begins as inward pressure exceeds the domed shape structural resistance. During the inner dome reversal I (18) event, the inner dome profile (12) demonstrates an inner dome reversal II (20) sequencing mode of radial deflection due to internal force centralizing concentration onto the inner domed profile (12). Continuing on, the inner dome profile (12) continues to deform reaching a full spherical radius deflection and reversal sequencing identified as inner dome reversal III (22) where the dome wall angle III (25) begins to displace inwardly. The inward leaning of the dome wall angle II (24) begins to collapse from A to B degrees as the profile structure folds over collapsing the traditional domed profile (10) toward a final reversal displacement failure mode. As shown in this figure, where the dome profile structural reversal deformation exceeds the profile boundaries, identified as inner dome reversal (28). This inner dome reversal (28) results in product failure, in-stackability. Moreover, dome wall angle IV (26) C, also identified as angle C, inwardly collapses to the point that it is unrecoverable. At this point, the traditional dome profile (10) reaches a stage of full structural reversal failure (30) where the dome profile exceeds profile boundaries causing complete un-stackability and final product profile structural reversal displacement failure mode.

Metal consumed by the inner or spherical dome profile (12) formation process is commonly known in the art as 'Pulldown' (32). Again, generally referring to FIG. 1, pulldown (32) represents the volume of metal or other material required due to dome profile depth (34). Specifically, a minimum pulldown (32) is required for traditional dome profiles (10) to meet the desired structural performance criteria. The amount of pulldown (32) is generally defined by the amount of container wall circumferential metal volume which is consumed by the inner dome profile (12) formation process. As can be seen in the figures, the deeper the inner dome profile (12) is formed, the more metal is consumed and the heavier the finished container or bottle will ultimately be. Inversely, as the dome depth (34) is reduced, the reversal resistance performance of the container is also reduced. In this manner, the effects of pulldown (32) are correlated directly to metal volume consumption of the starting material that moves downward in the circumferential walls of the body diameter or geometric shape of the inner dome profile (12). As a result, when the inner dome depth (34) is increased, the weight of the container and metal needed to manufacturer the container also increases.

As noted above, the reduction of pulldown by other means or methods has produced excessive material thinning resulting in product formation defects such as fractures or other structural defects reducing container performance and axial strength. These problems define the limitations of existing art shown in FIG. 1 as the lowering dome depth (34) reaches a condition where the physical structural reversal resistance, shown sequentially in elements 18, 20, 22, 28 and 30 of FIG. 1, does not meet the minimum container performance requirements and inversely creates a heavier than optimal container weight via increased material consumption of traditional dome profile (10) geometries.

The lightweight dome profile (100), in particular the decreased depth of the dome profile or dome depth (134), directly reduces pulldown (132). Due to the controlled sequential dome profile deformation attributes described herein, the depth of the dome (134) for the lightweight dome profile (100), as opposed to the dome depth (34) of a traditional dome profile (10) shown in FIG. 1, meets the acceptable dome reversal resistance, reduces the total metal volume consumed during manufacturing, allows a reduction in the outside diameter of the canister body, and provides the option of a lower starting metal gauge as well as a lower metal alloy yield strength—while increasing container performance and reducing the final container weight significantly. In a certain embodiment, the lightweight dome profile may have a dome depth 20-75% less than the dome depth of a comparable traditional container. The lightweight dome profile may also have less pulldown compared to a comparable traditional container.

In one embodiment, the invention includes a novel, lightweight dome profile (100) that may be configured to include one or more geometric contoured shapes that are configured to allow the controlled sequential dome profile deformation of the dome profile (100) in response to an exerted force, such as may be generated from internal liquid pressurization, dropping the container from a height, or through pasteurization processes as generally described herein. In this preferred embodiment, a centrally positioned initial deformation panel (110) may be integrally positioned in the inner dome profile (111). In this preferred embodiment, initial deformation panel (110) may be configured to undergo a controlled sequential dome profile deformation in response to an exerted force, such as internal pressure changes in a container.

Again, as generally showing in FIGS. 2-3, and 4-7, an initial deformation panel (110) may form, and/or be integrally coupled with one or more geometric contoured shapes. In the preferred embodiment shown, an initial deformation panel (110) may include a deformation panel boundary (113) having one or more spherical radii or tangential radial segments (146, 145) that may further be coupled with a plurality of buttressing structures (140), separated by alternating geometries extending radially outward from the initial deformation panel (110) to the inner leg (150) of the dome profile. As noted above, these geometric contoured shapes may act synergistically to allow a controlled sequential dome profile deformation as generally described below.

Figure 2:
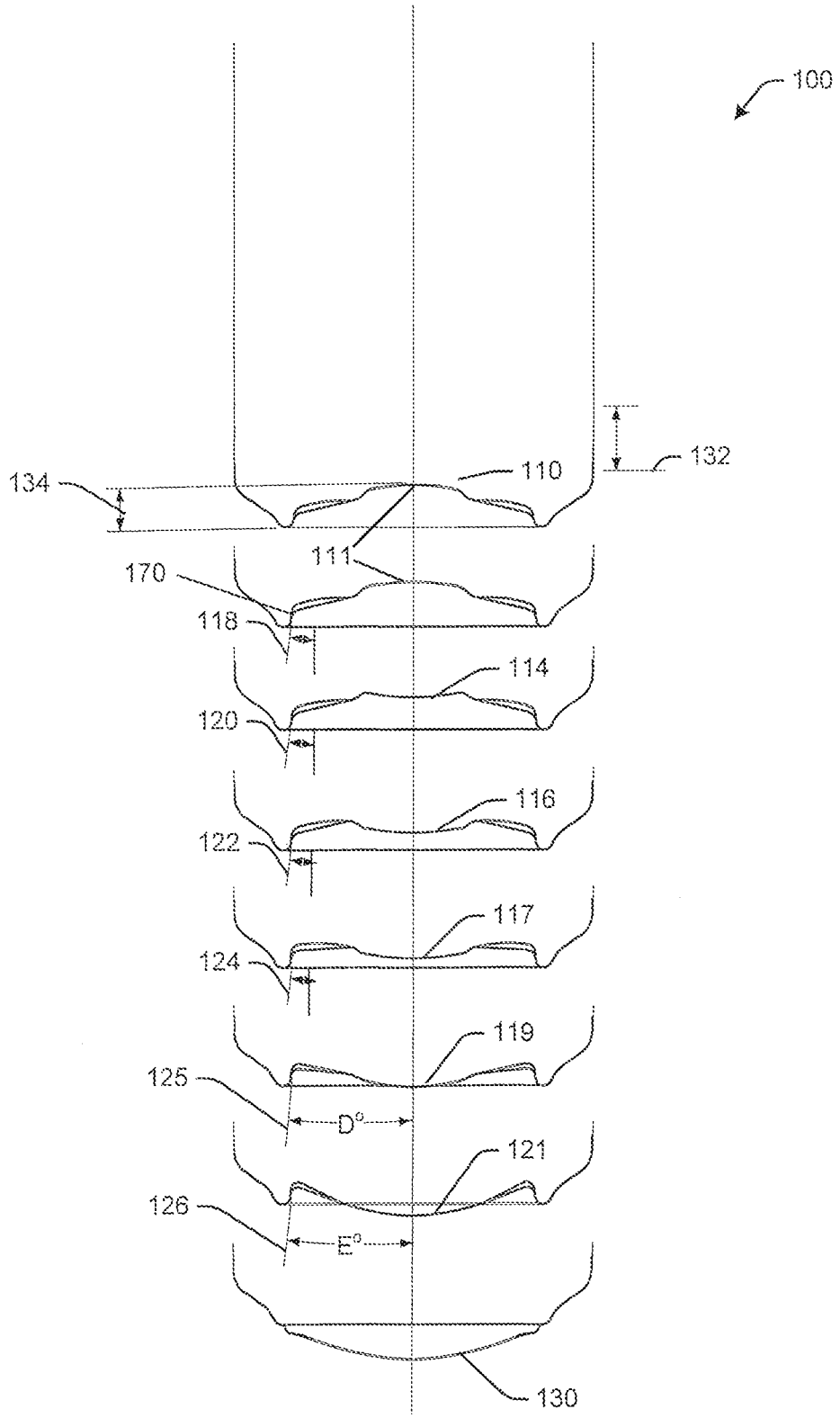
FIG. 2: illustrates a container dome profile according to the disclosure herein, wherein the novel geometric configurations of increased strength and reduced material consumption through strategic application of favorable geometric contoured shapes within the profile result in the sequential dome profile deformation. As detailed below, the geometric contoured shapes combine and merge in a complimentary mechanical system during material displacement, resulting in the novel sequential dome profile deformation. As also generally shown in FIG. 2, in certain embodiments, the strategic placement of geometric contoured shapes helps generate a controlled sequential dome profile deformation which may be characterized by movement of the geometric contoured shapes in a controlled displacement, resulting in a controlled and phased failure mode sequencing that is more resistant to reversal deformation. As also shown in FIG. 2, the unique geometric contoured shapes congruently compose a technical method of controlled sequential dome profile deformation to appreciatively increase the inner dome profile reversal strength through specific buttressing features. In this manner, the lightweight dome profile is able to maintain its strength and structural deformation resistance, such as might be required by industry standards or a customer's request, while utilizing lighter gauges of starting material.

In one embodiment, the lightweight dome profile (100) may be configured to undergo a controlled sequential dome profile deformation. As shown in FIG. 2 generally, in a preferred embodiment reversal energy is exerted on the geometric contoured shapes of the lightweight dome profile (100) causing the displacement the coupled geometric contoured shapes or structures in a complimentary and controlled manner of primary force transference of displacement energy via work energy of the adjacent geometric structures. The displacement energy generates deformation forces during the container profile geometric structural movements that may result from excessive internal pressurization via various means such as fluid pressurization, gaseous pressurization, such as may be caused by a buildup of carbon-dioxide or nitrogen, drop energy, growth energy in pasteurization or dome reversal displacement energy.

Referring again to FIG. 2, in this preferred embodiment a reversal energy is exerted on the initial deformation panel (110) causing it to initiate a controlled sequential dome profile deformation. Here, the initial deformation panel (110), in response to the application of a reversal energy, begins to collapse in an initial dome reversal action. However, the preliminary movement of the initial deformation panel (110) transfers the reversal energy input outward into the adjacent buttressing structures (140). This energy transfer allows the conversion of the reversal energy into structural leverage of adjacent buttressing structures (140) via outward lateral displacement. As such, the leveraged deformation strain energy passing through the buttressing structures (140) initiates lateral dome profile displacements through outward compression supporting the vertical consistency of inner dome wall angle or inner conical leg angle (118). This change of leveraged deformation energy enables the work of the lateral deformations in the lightweight dome profile (100) to transfer vertical force concentration laterally such that the buttressing structures (140) reinforce and thereby retain the position of the inner dome wall (170). This action maintains the vertical orientation angle of the inner conical leg angle (118).

As opposed to a traditional dome profile outline in FIG. 1, this prolonged retention of the inner conical leg angle (118) prevents collapse of the angle as identified as inner conical leg angle I (120), inner conical leg angle II (122), inner conical leg angle III (124). Specifically, as the reversal energy causes the reversal deformation of the initial deformation panel (110) and may transfer the reversal energy input outward into the adjacent buttressing structures (140) causing further lateral leverage in the adjacent buttressing structures (140) which, in turn, further reinforces and thereby retains the position the inner dome wall (170), maintaining the vertical orientation angle of the inner conical leg angle (118). In this manner, as the initial deformation panel (110) begins its deformation movement, the transfer of energy laterally into the buttressing structures (140) may lock-in the inner conical leg angle (118).

In this embodiment, the synergistic effect of the lightweight dome profile (100) is such that as the deformation energies continue to strengthen, the buttressing structures (140) concurrently increase their mechanical leveraged action to prevent the collapse of the inner conical leg angle (118). Collapse of the inner conical leg angle (118), being an important structural failure inflection point that may result in, for example, complete dome reversal (130). The longer the inner conical leg angle (118) can be maintained, the more resistant the lightweight dome profile (100) is to the reversal energy and profile deformation movements that may result in loss of structural integrity and/or dome reversal.

Again referring to FIG. 2, structural displacement of the initial deformation panel (110) allows energy transference to the initial deformation panel (110), (generally being shown as sequential failure modes, shown here as initial deformation panel reversal I (114), initial deformation panel reversal II (116), and initial deformation panel reversal III (117), to be controlled and sequential. Specifically, the configuration of the lightweight dome profile (100) allows movement of the initial deformation panel (110) which in turn causes the buttressing structures (140) to react to the deformation energy by transferring forces outward with displacement to "lock in" the inner conical leg angle (118), and retain the profile structure, for example, identified as initial deformation panel reversal III (117), over a prolonged and high force potential. The prolonged vertical orientation of the inner conical leg angle (118) over an extended time (such angles being identified at sequential failure modes by numbers 118, 120, 122, 124, 125, 126) demonstrates the primary structural improvements of the buttressing geometries displacing internal deformation energy of the inner dome profile (111) outward displacement which significantly increases dome profile total reversal performance by delaying collapse of the inner conical leg angle (identified here as number 126), resulting in significantly improved dome profile geometries resistance to deformation failure.

It should be noted that the shape, placement, orientation, number, and configuration of geometric contoured shapes utilized in the a lightweight dome profile (100) may be customized to be adaptable to various container sizes, materials, conditions or specifications. Such characteristic may be modified to conform to industry or customer's requirements, or container use applications, such as a need to be pasteurized or stored in a location with high ambient temperature. For example, in some instances a initial deformation panel (110) may have a larger diameter, and/or may be coupled with one, or a plurality of buttressing structures (140), which may further take a variety of forms and shapes. Such an example is non-limiting and is merely provided to show the high-level of customization and adaptability in the invention's lightweight dome profile.

The shape and size of the spherical radius of the initial deformation panel (110) in specific combination of radii (145, 146) may allow modulation of the actual and specific value of controlled structural reversal pressure of the lightweight dome profile (100). This initial deformation panel (110) of the lightweight dome profile (100) may be optimized through modulations in size, diameter, radii, placement and number, to deflect and deform initially, providing the energy transference of structural enhancement through buttressing outward leverage. The actual starting gauge of a metal, in combination of these geometric size options of initial deformation panel (110), and radii (145, 146) may produce a specified and controllable failure pressure utilized to produce the primary displacement actions, providing structural energy to the remaining geometries of the lightweight dome profile (100).

This displacement action of the initial deformation panel (110) may utilize the displacement energy of the structural deformations to increase and strengthen the lightweight dome profile (100) in sequential failure modes, generally shown here as initial deformation panel reversal I (114), initial deformation panel reversal II (116), and initial deformation panel reversal III (117), through the lateral displacement leverage of the buttressed structures supporting the inner conical leg angle (in this embodiment shown at inner conical leg angle IV (125)) of the inner dome wall (170) prior to crossing a threshold of reversal failure, which in this embodiment may be shown where the inner conical leg angle is identified at 126 and/or full structural reversal failure (30). This structurally reinforcing action may compliment the profile strength of any can size and any container base dome profile by enhancing the structural reversal displacements of the adjacent geometries. In this manner, the complimentary action of this laterally deflected energy is structurally improving and strengthening geometries of the lightweight dome profile (100).

Referring again to FIG. 2, continued inner dome or inner conical leg angle (118) deformation through sequential failure modes (122, 124, 125) demonstrate the extended failure modal response of the buttressed and paneled structural geometries. Indeed, the invention provides specific structural enhancements through deformation displacement of structural geometries including a initial deformation panel (110) focusing deformation energy and distributing displacement forces outwardly improving buttressing and geometric panel (160) structures respectively, resulting in improved vertical containment of inner conical leg angle (118) for the maximum resistance to failure, maximum resistance to dome growth and maximum resistance to drop performance structural characteristics.

Figure 3A:
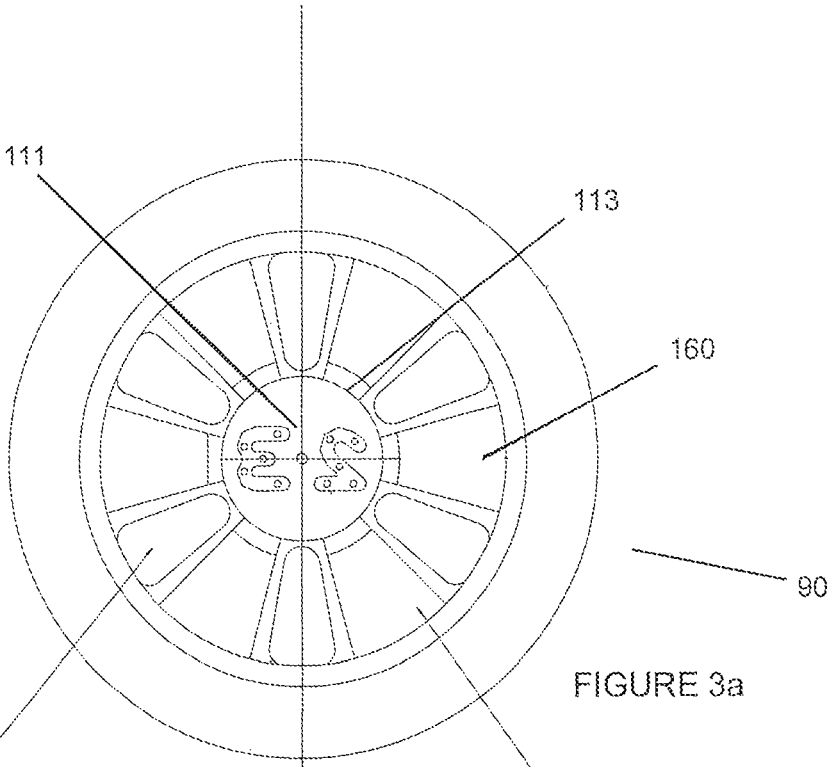
FIG. 3*a-b*: illustrates an end-view as well as isolated cross-sectional perspective of a metallic container having a plurality of geometric contoured shapes. In this embodiment, such geometric contoured shapes include panel and intertwined buttressing structures configured to generate a controlled sequential dome profile deformation as generally described herein.
Figure 3B:
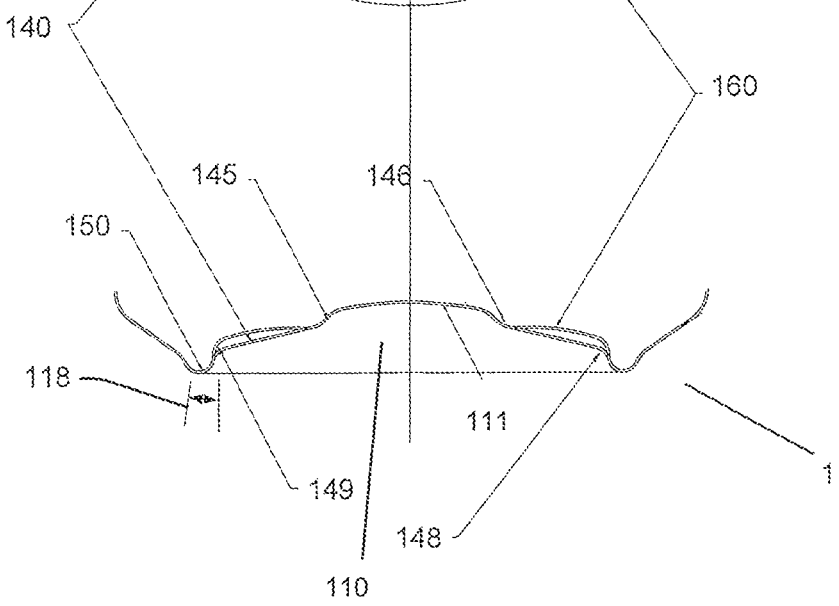
Figure 4:
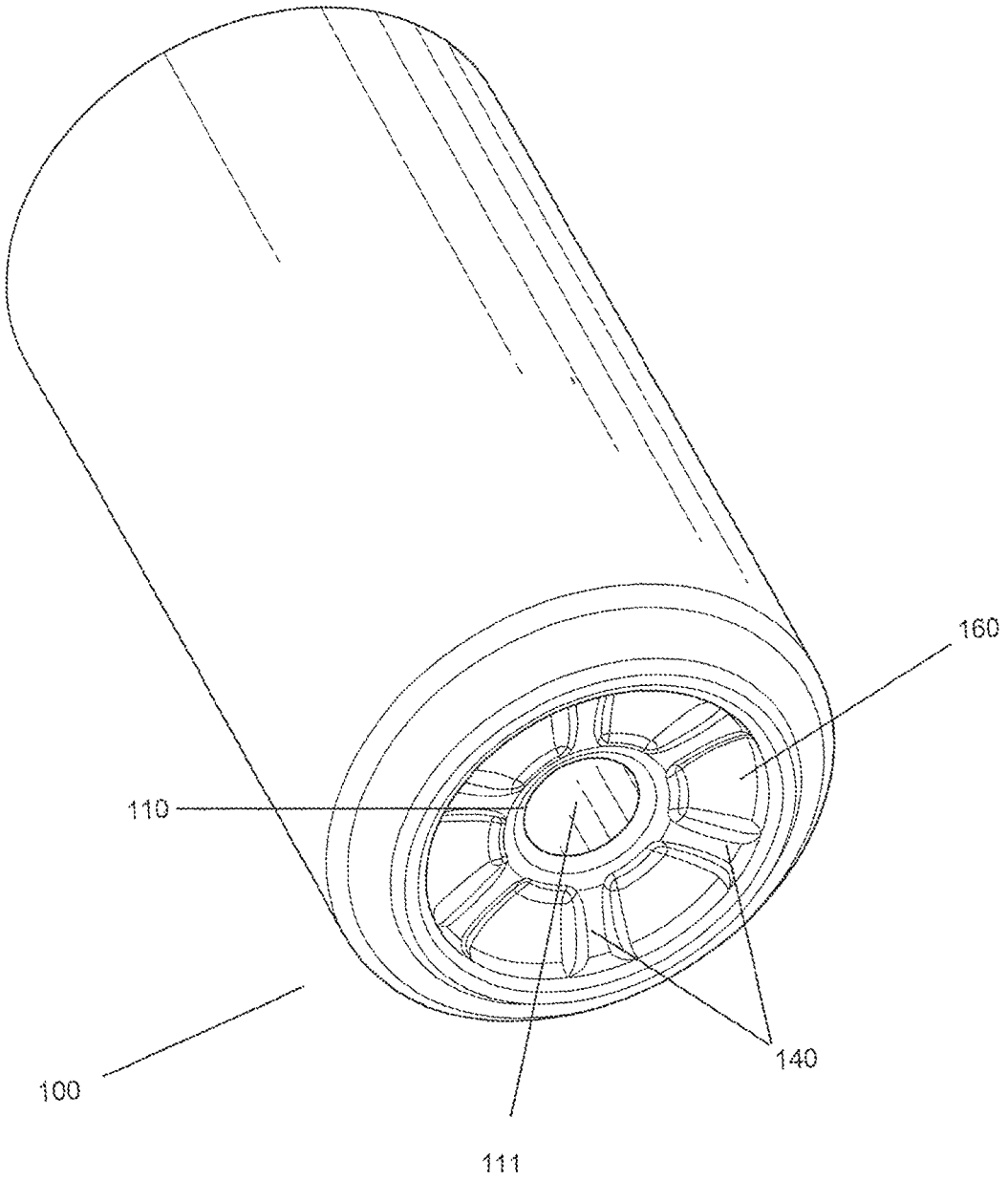
FIG. 4: illustrates a perspective view of metallic container having a dome profile configured with a centrally positioned initial deformation panel coupled with a plurality of buttressing structures configured to initiate a controlled sequential dome profile deformation in one embodiment thereof. This figure further illustrates an exemplary deformation panel boundary, buttressing structures, and geometric panels, in one embodiment thereof.
Figure 5A:
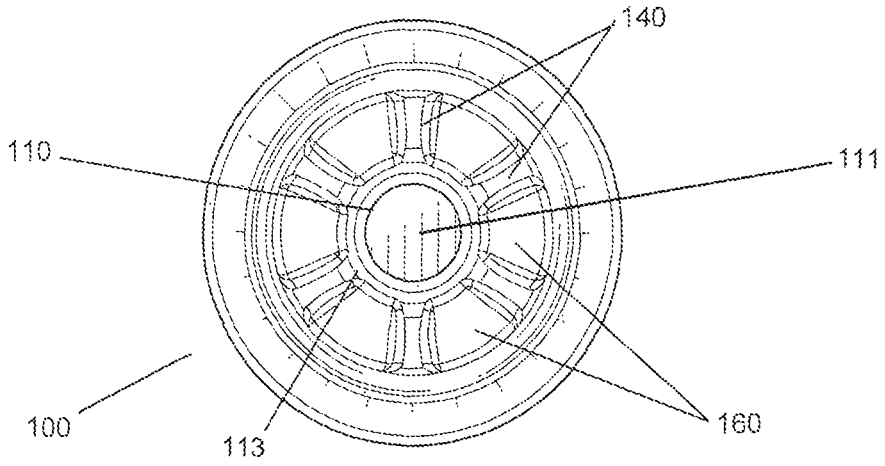
FIG. 5*a*: illustrates a front-facing view of metallic container having a dome profile configured with a centrally positioned initial deformation panel coupled with a plurality of buttressing structures configured to initiate a controlled sequential dome profile deformation, in one embodiment thereof.
Figure 5B:
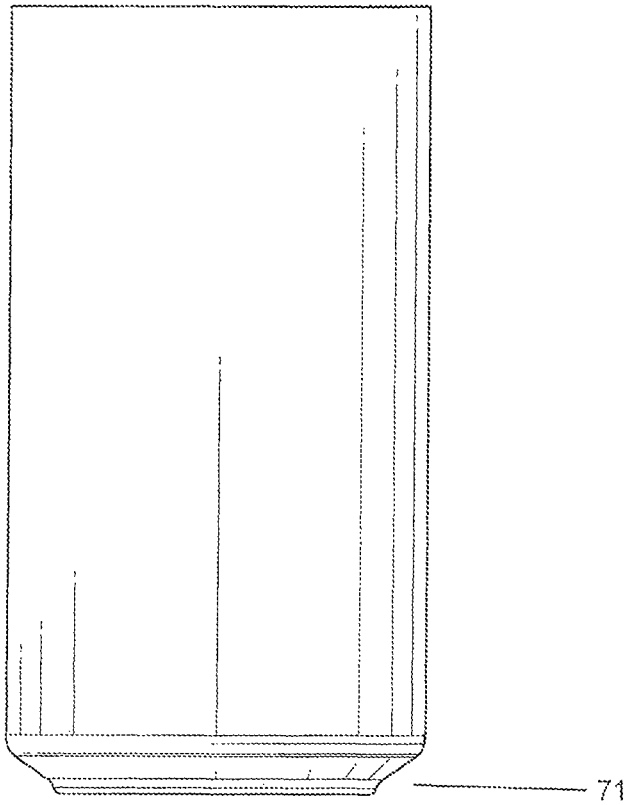
FIG. 5*b*: illustrates a side view of metallic container having an external dome profile dome profile, in one embodiment thereof.
Figure 6A:
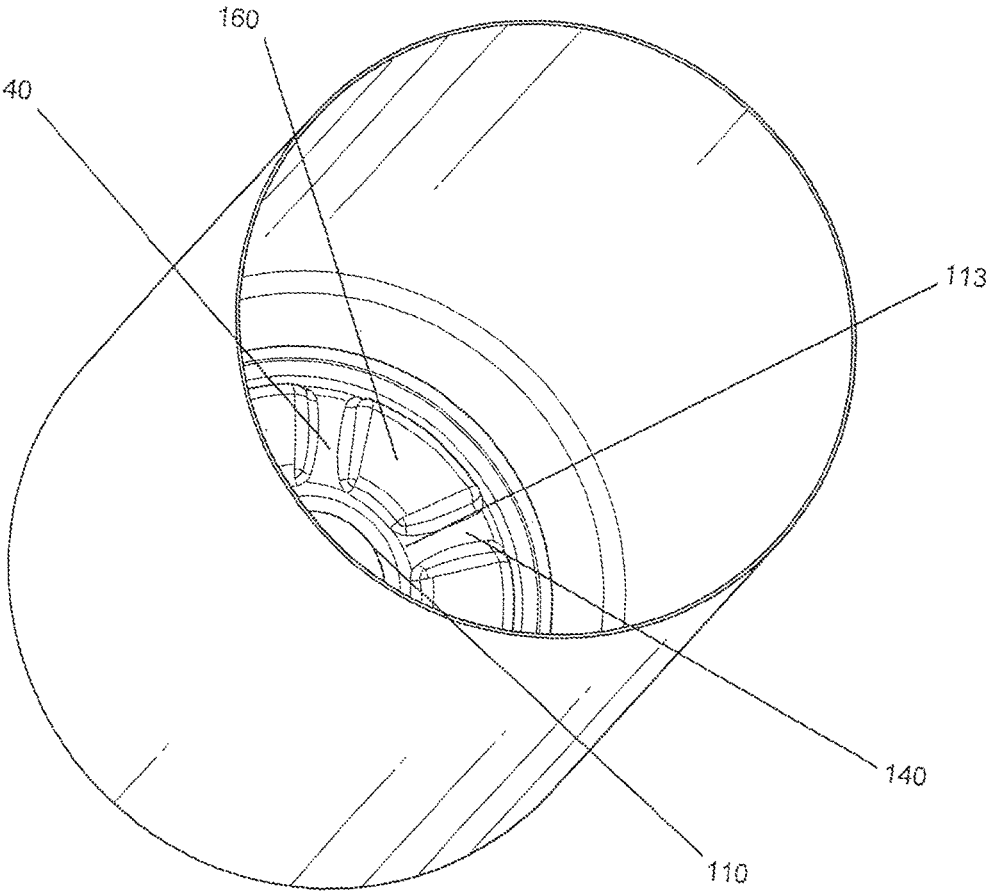
FIG. 6*a*: illustrates a perspective view of the internal cavity of a metallic container having a dome profile configured with a centrally positioned initial deformation panel coupled with a plurality of buttressing structures configured to initiate a controlled sequential dome profile deformation, in one embodiment thereof.
Figure 6B:
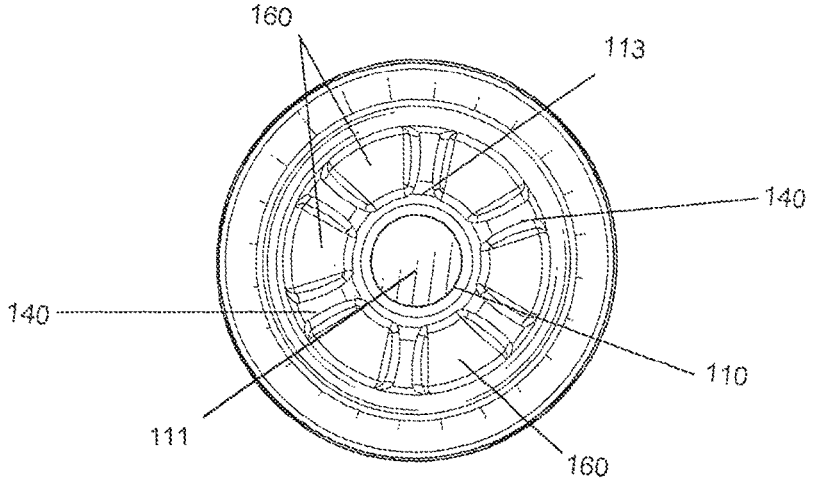
FIG. 6*b*: illustrates a top view of the internal cavity of a metallic container having a dome profile configured with a centrally positioned initial deformation panel coupled with a plurality of buttressing structures configured to initiate a controlled sequential dome profile deformation, in one embodiment thereof.
Figure 7:
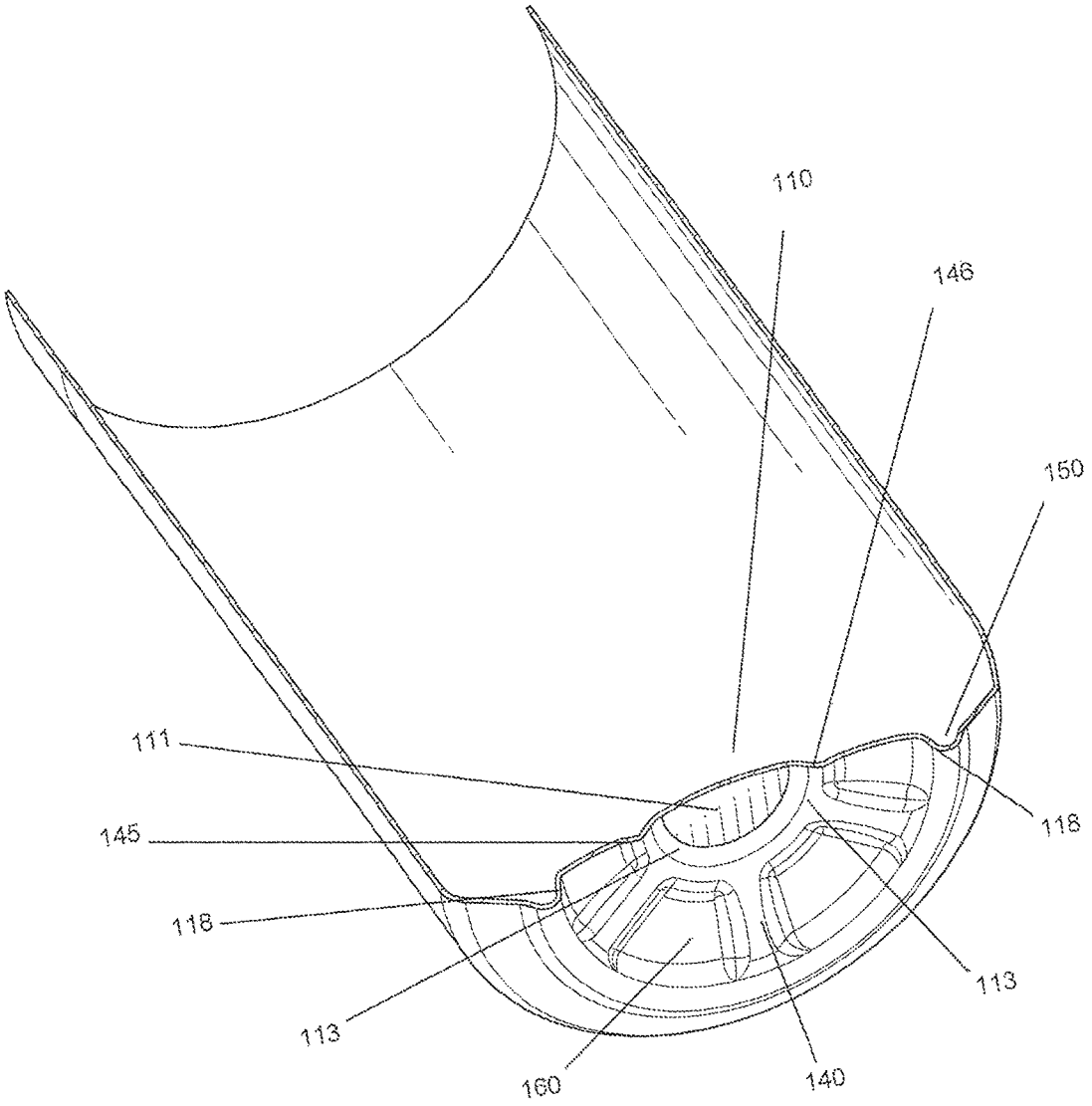
FIG. 7: illustrates a cross-sectional view of the internal cavity of a metallic container having a dome profile configured with a centrally positioned initial deformation panel coupled with a plurality of buttressing structures configured to initiate a controlled sequential dome profile deformation, in one embodiment thereof.

It should be noted that a variety of configurations may be considered to be within the scope of the invention. For example, in one embodiment a single initial deformation panel (110) may be coupled with a plurality of buttressing structures (140). In the preferred embodiment shown in FIG. 3, a single initial deformation panel (110) may be approximately positioned within the center of the inner dome profile (111) and have a radius that is approximately less than that of the container, and in some instances the inner leg (150). In this preferred embodiment, six individual buttressing structures (140) may be coordinated with the centrally positioned initial deformation panel (110). Such individual buttressing structures (140) may be configured to be separated by sequentially positioned geometric panels (160), and may further be configured to maintain the inner dome wall or inner conical leg angle 118 at the formed angle over a longer period of force application and to withstand higher levels of force resistance as described above. In some embodiments, pairs of buttressing structures (140) may be positioned in opposing positions, while in other embodiments, for example as shown in FIG. 3, may be positioned sequentially and equidistantly around the centrally positioned initial deformation panel (110). Naturally, the position and number of buttressing structures (140) and geometric panels (160) may be modular in nature such that they can be configured to provide the desired level force resistance based on the size of container, amount of liquid intended to be container within the container, the type and/or gauge of a starting material, as well as the softness of the alloy utilized. For example, in some embodiments, a single pair of buttressing structures (140) may be configured in opposing positions coupled with a positioned initial deformation panel (110). Additional embodiments may include anywhere from 1, to a plurality of buttressing structures (140) depending on the variable described above.

As further shown in FIGS. 2-3, as the initial deformation panel (110) sequentially passed through the failure modes previously described (generally identified as initial deformation panel reversal I (114), initial deformation panel reversal II (116), initial deformation panel reversal III (117), and initial deformation panel reversal IV (119), at a certain point it may reach failure mode(121) wherein it reaches a maximum displacement position. At this maximum displacement failure mode (identified as initial deformation panel reversal V (121), the inner dome profile (111) of the initial deformation panel (110) stretches the geometric contoured shapes, such as the buttressing structures (140) and the like, resulting in the failure of outward force containment of inner the conical leg angle (118) at a maximum reversal resistance performance for the starting gauge material.

As noted above, those skilled in the art of container and bottle failure or performance often observe primary problems of traditional dome profiles in the failure mechanics and failure modes being highly correlated around the limitations of traditional geometries established around spherical radii domed shapes. As a result, traditional dome or spherical profiles demonstrate distinct limitations in which deformation resistance to internal pressure reaches a point of exceeding the elastic limit resistance of the domed spherical radius shape or inner dome profile (12) resulting in a complete dome reversal of the geometric formation.

Common testing for burst pressure often demonstrates this common unrolling and/or unwrapping of the geometric configurations of traditional dome profile (10) features. Specifically, traditional dome profiles (10) undergoing inner dome profile (12) deformation and failure sequencing continue to quickly unravel the tangential profile geometries of the inner post reversal of the spherical shape due to the concentration of the internal forces being focused onto these geometries. The increased intensity of focused tensile loading from this localization of internal pressurization forces directly transmit onto the tangent radii of the inner dome conical leg angle, for example as shown in FIG. 1 at numbers 24 and 26. The concentration of this tensile loading will transfer energy into unraveling and collapse of the vertical orientation of the inner dome leg geometry by destabilizing the inward protrusion profiled geometry. The highly-leveraged forces easily collapse the tangential support leg of the inner dome profile (12) due to the instability of the dome with concentrated leverage of deformation energy in this instantaneous effect of unwrapping the geometry.

For example, the direct concentration of high tensile leverage exerted, of for example as shown in FIG. 1 at numbers 24, 25, 26, focuses displacements of instability inducing reversal of the inner dome profile (12). This becomes a distinct disadvantage for traditional dome profiles (10), and in particular traditional inner dome profiles (12) such as that shown in FIG. 1. Specifically, this localization of instability through such translated tensile energies focuses concentration onto the radius at the top of the support leg or dome shoulder radius (14). This high concentration of energy results in unstable unbalanced displacement and deformation inducing inner conical leg collapse angle 'C' generally identified as number 26. The limitations of traditional dome profile (10) to prevent the force concentration of these tensile energies in this geometry resulting from internal pressure forces directly transfer the deformation energy into the support leg or dome shoulder radius (14), inducing reversal of the spherical inner dome profile (12), directly unravelling the remaining geometries resulting in full structural reversal failure (30). Notably, as shown in FIG. 1, once the spherical inner dome profile (12) reverses as deformation increases from internal pressure increases, there is an immediate degradation of the structural failure resistance of the profiled shape, resulting in inferior performance.

As again shown in FIG. 1, the intensification of these deformation energies directly concentrates within support leg or dome shoulder radius (14) and quickens the failure mode, immediately deforming and collapsing the inner conical leg or inner conical leg angle identified in number 26 of the traditional dome profile (10). Indeed, as shown in the final failure mode of FIG. 1 identified as number 30, total failure deformation completely unwraps the inner dome profile (12) as the focused tensile force gains momentum leverage exceeding the structural resistance displacement focus of the spherical geometric formation displacement, shown generally at number 28.

To illustrate this transition to a final failure mode, during typical abuse testing, skilled observers in the art audibly observe this failure event as a "pop" or a clear audible sound of final reversal blowout of the inner dome profile (12) geometry. These events typically occur below the peak reversal pressure of final testing observance. As a result, the full structural reversal failure (30) of the dome deformation happens abruptly under significantly less internal force than the peak reversal pressurization experienced and terminates with complete unwrapping of the dome wall angle I (16) in a traditional dome profile (10). Therefore, the reversal pressure resistance of traditional dome profile (10) reduces significantly once the first modal failure sequence of the dome radius reversal occurs past displacement, identified as inner dome reversal III (22). The continued time of this abrupt full structural reversal failure (30) mode is significantly shortened once the spherical radius reversal event, shown at number 22, has been reached.

As described herein, the novel lightweight dome profile (100) of the present invention overcomes these early structural sequential failure accelerating sequences. Specifically, geometric contoured shapes, including a initial deformation panel (110), buttressing structures (140), geometric panel (160) and/or a deformation panel boundary (113) utilize the buttressing structures (140) and/or geometric panel (160) deformation energy in complimentary leveraged resistance, utilizing displacement of elements' structural geometries, increasing structural resistance to the unwrapping failure mode of inherent traditional dome profile (12) designs. In a preferred embodiment, one or more buttressing geometric features (140) utilize the deformation energy initial deformation panel (110), for example as shown at number 111, to lock the displacements of the center spherical panel geometries, shown at initial deformation panel reversal modes I (114), and II (116) respectively, which results in significantly higher force structural resistance and failure resistance at a lower dome depth (134) and less starting material than traditional dome profiles (10).

As would be appreciated by one of ordinary skill in the art, traditional dome profiles (10) suffer from dome fracture during formation and manufacture. During the dome formation process the inner leg depth induces thinning of the starting material thicknesses which is stretched and drawn around the inner domer tooling radii during formation. The metal shape is wrapped and stretched around the inner nose radius of the tool, while it is also clamped externally from the outer domer profile of the base geometry for stackability. Therefore, the dome shoulder radius (14) radius material is in high tensile load which increases as the depth of dome (34) increases. Increasing dome depth improves failure resistance, directly increases thinning of profiles, for example the dome shoulder radius (14) and punch nose radius (15), often resulting in increased fracture problems due to exceeding elastic limits of the material. The manufacturers of containers and bottles must also complete an inspection for fracture and crack detection within the traditional dome profile (10) geometries of all containers produced. Often these fractures are difficult to detect and may not be fully visible by the light and/or camera based detection systems. These fractures may often be sub-surface and frequently do not become visibly evident until they are pressurized and/or filled with product. The failure effects of filled containers with product may occur instantly once filled and/or pressurized, or over time the failure may be delayed where failure causes greater damage of stored products and surrounding storage facilities. The fracture tendency and frequency of traditional dome profile (10) geometries greatly increases as the dome depth (34) is increased to meet minimum failure resistance pressure requirements of thinner, more weight efficient gauges. This interaction is especially prevalent as the starting material gauge thickness becomes thinner and thinner. "Lightweighting" activities applied to container and bottle manufacturing processes and material often increases the dome fracture frequency and product failure rates as the dome depth (34) is increased. Additionally, common to the art of dome formation is the limitation of the thickness of the starting metal gauge required to meet the required industry standard quality structural performance characteristics. Traditional dome profiles (10) require post-processing for starting material gauges below about 0.0106 inches or lower temper and yield strength alloys below 45 ksi. The use of thinner starting material gauges is prevented by current art due to the limited failure structural resistance performance of gauges less than about 0.0106 inches. Those skilled in the art are versed in data demonstrating that dome reversal, dome growth and drop strength performance all degrade with traditional dome profiles (10) as the starting material gauge is reduced below this threshold. This limitation of gauge thickness directly limits the container and bottle achievable material weight savings.

As described herein, the lightweight dome profile (100) resolves these issues and reduces the fracture rates, with less metal thinning problems by directly reducing the required dome depth formation sensitivities with significantly lower tensile intensity concentrations of material stretching induced during improved dome profile formation and intrinsically reduced dome depth requirements of the initial deformation panel (110) structures, geometric panel (160) structures and buttressing formations (140) while meeting and exceeding the industry minimum dome failure structural resistance performance. Moreover, such geometric contoured shapes integrally formed in a lightweight dome profile (100) not only eliminate the need for post-processing or reforming. For example, embodiments of the lightweight dome profile (100) may allow for starting gauges below about 0.0106 inches, or lower temper and yield strength alloys below 45 ksi without the need for additional post-processing or reforming.

In one embodiment, the invention includes a novel dome profile (1). Generally referring to FIGS. 3 through 7, in one preferred embodiment the dome profile (1) may be configured to undergo an initial structural deflection sequencing as generally shown in FIG. 2.

Figure 9A:
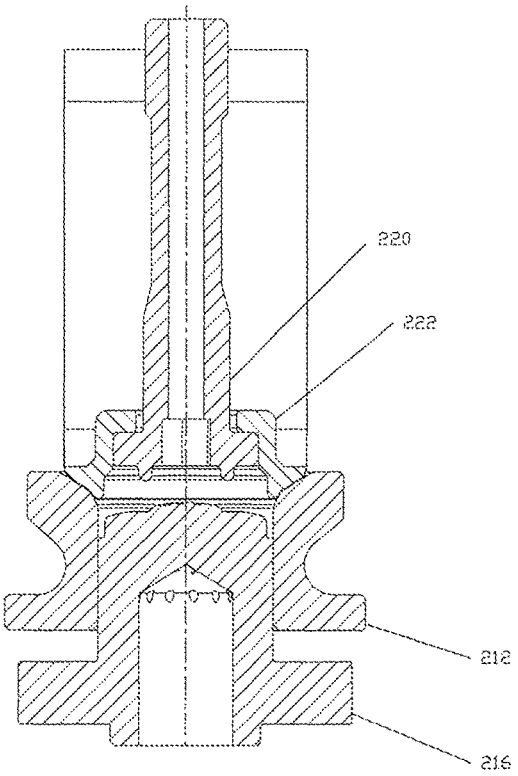
FIG. 9*a-b*: illustrates a dome forming tool that may be used to manufacturer a metallic container having a dome profile configured with a centrally positioned initial deformation panel coupled with a plurality of buttressing structures configured to initiate a controlled sequential dome profile deformation, in one embodiment thereof.
Figure 9B:
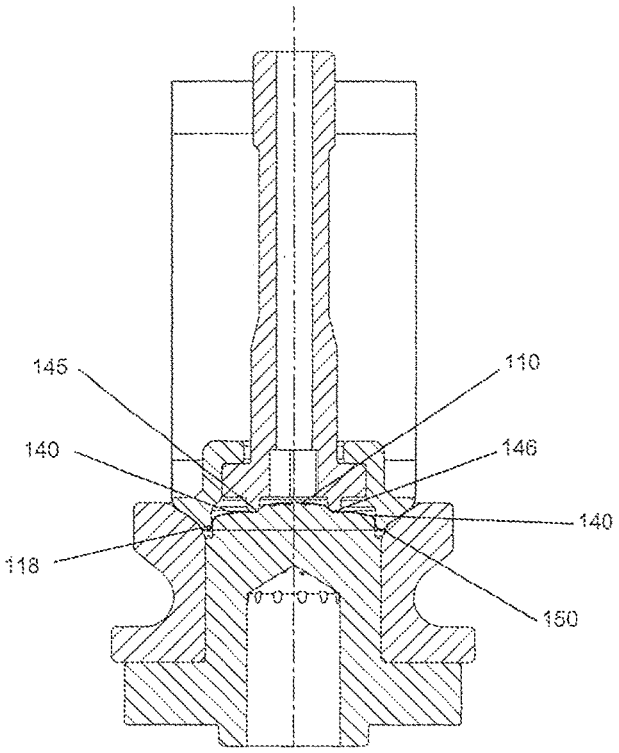

As noted above, the invention includes methods of manufacturing the lightweight dome profile (100). As generally shown in FIGS. 9 and 9*a-b*, a lightweight dome profile (11) may be manufactured using formation devices as generally disclosed. In this embodiment, the tool may include a punch sleeve (230) with a corresponding punch nose (222) and a punch bolt retainer (220) mounted onto a cyclic ram of a "bodymaker." Additionally, this tooling (200) may further include of an inner dome die (210) which may form the profile (212) which may also be referred to as the "dome post." An outer domer die (216), also referred to as a "clamp ring" and a clamp ring retainer (214) are also demonstrated.

In one embodiment, aluminum or steel coil—rolled to a desired thickness, may be initially established. Next, a cup may be cut and drawn from the aluminum or steel coil sheet which may then be fed into a bodymaker which irons, or reduces the wall thickness. In the case of a can, the cup is positioned so as to be manipulated by the stroke of a bodymaker ram. Here, the initial dome structure is formed at the end of each stroke of the bodymaker. Next, a set of dome tools form the dome shape while an outer domer die clamps and holds the metal taught while the ram stroke continues to form the dome. At this point, an inner domer, which is generally spherical in shape, and stretches the inner dome portion of the base profile.

Figure 8:
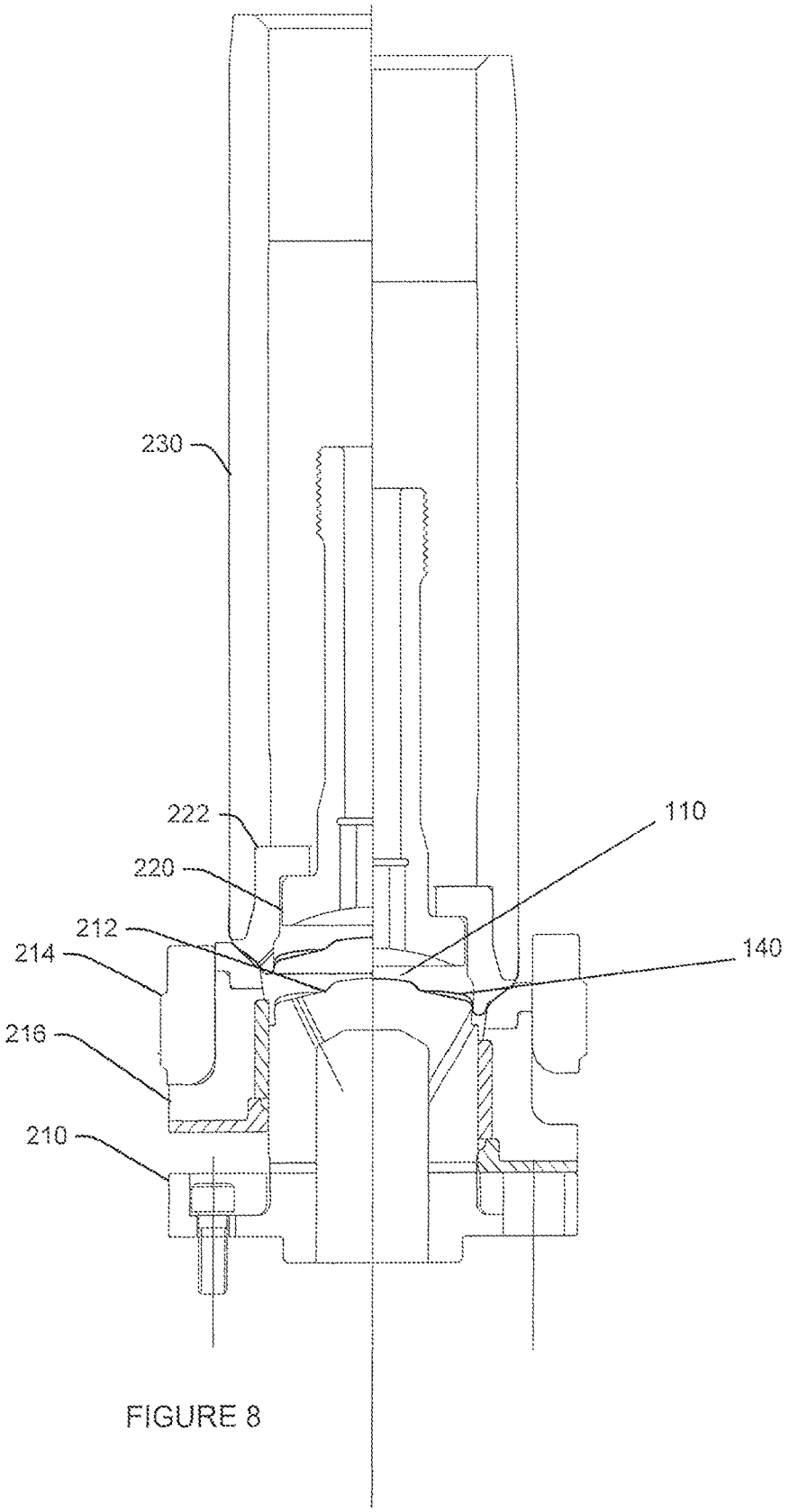
FIG. 8: illustrates a dome profile formation device and tooling arrangement that may be used to manufacture the novel dome profile, in one embodiment thereof.

In a certain embodiment, the lightweight dome profile (110) geometries may be generated using a coining punch. This may be accomplished by using a triple action doming assembly in which the formation process may be assisted with vacuum drawing of the inner panel geometries. In combination with a coined feature defined by the "punch bolt'" to improve the initial deflection panel edges and clarify the shape outline. These key aspects are unique to the form of the new profile using the punch bolt to define initial deflection panel formation. As shown generally in FIGS. 8-9, this punch bolt may create the definition of the circularity or shape of the initial panel tangential radii connecting the features to the initial deformation panel (110), buttressing structures (140), geometric panels (160) and/or a deformation panel boundary (113). This shaped punch bolt may be used as a coining feature to define and set the geometry properly for the desired strength and deflection/failure sequencing demonstrated in the lightweight dome profile's (100) ability to initiate a controlled sequential dome profile deformation.

Compared to traditional dome profiles (10), the invention's lightweight dome profile (100) varies in the method of dome depth formation by utilizing unique tooling geometries. The lightweight dome profile (100) may form the depth of the dome shape at much lower depths than traditional dome profiles (10). This in turn provides metal savings, by using less material. The added shape and definition is provided by the unique geometric contoured shapes and the profile combinations as described herein to increase dome strength.

As used herein, the term "includes" and "including" mean, but is not limited to, "includes" or "including" and "includes at least" or "including at least." The term "based on" means "based on" and "based at least in part on."

As used herein, the terms "can," "container," "preform" and/or "bottle" may be used interchangeably and generally include shaped, ironed or formed metallic containers.

As used herein, the term "about" or "approximately" generally refers to a range include a plus or minus value of up to a 15% variance.

While the invention has been described in connection with a preferred embodiment, it is not intended to limit the scope of the invention to the particular form set forth, but on the contrary, it is intended to cover such alternatives, modifications, and equivalents as may be included within the spirit and scope of the lightweight dome profile invention as defined by the statements of invention. Indeed, as can be easily understood from the foregoing, the basic concepts of the present invention may be embodied in a variety of ways. It involves both lightweight dome profile designs, devices and methods to manufacturer the same. In this application, the lightweight dome profile designs, devices and methods of manufacturing the same, are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing the explicit embodiment(s) shown, the great variety of implicit alternative embodiments, and the broad methods or processes and the like are encompassed by this disclosure and may be relied upon when drafting any claims. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action.

Similarly, each physical element disclosed should be understood to encompass a disclosure of the action which that physical element facilitates. Regarding this last aspect, as but one example, the disclosure of a "buttress" should be understood to encompass disclosure of the act of "buttressing"—whether explicitly discussed or not—and, conversely, were there effectively disclosure of the act of "buttressing", such a disclosure should be understood to encompass disclosure of a "buttress" and even a "method for manufacturing a buttress or buttressing structure." Such changes and alternative terms are to be understood to be explicitly included in the description.

Any patents, publications, or other references mentioned in this application, for example through a concurrently or later submitted Information Disclosure Statement, are hereby incorporated by reference. Any priority case(s) claimed by this application is hereby appended and hereby incorporated by reference. Thus, the applicant(s) should be understood to have support to claim and make a statement of invention to at least: i) each of the devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application.

Limitations such as arose in Hakim v. Cannon Avent Group, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. It should be understood that this phrase also provides support for any combination of elements in the claims and even incorporates any desired proper antecedent basis for certain claim combinations such as with combinations of method, apparatus, process, and the like claims.

Furthermore, it should be noted that certain embodiments of the current invention may indicate a coupler, or the step of coupling or two or more items that may be coupled. It should be noted that these may indicate a direct, or in some cases an indirect connection and/or bring together of disparate or non-disparate elements in a functional, non-functional or desired configuration.

Additionally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A deformation resistant metal container comprising:

a lightweight dome profile positioned at a terminal end of a metal container that is configured to be capable of a controlled sequential dome profile deformation where said lightweight dome profile further comprises:

at least one initial deformation panel positioned at a central position on an inner dome profile of said lightweight dome profile wherein said initial deformation panel comprises an inwardly raised domed structure defined by one or more tangential radial segments;

a deformation panel boundary coupled with said initial deformation panel forming the circumferential boundary of said lightweight dome profile;

a network of buttressing structures positioned between a plurality of geometric panels coupled with said lightweight dome profile deformation panel boundary;

a circumferentially positioned inner leg configured to have an inner conical leg angle integrally coupled with said network of buttressing structures and said plurality of geometric panels; and wherein said controlled sequential dome profile deformation is initiated in response to the application of a deformation energy to said lightweight dome profile such that movement of said initial deformation panel transfers said deformation energy outwardly through said deformation panel boundary onto said plurality of networked buttressing structures generating a leveraged deformation displacement action that supports said inner conical leg angle reinforcing the structural integrity of said lightweight dome profile.

2. The deformation resistant metal container as described in claim 1 wherein the initial deformation panel comprises an inwardly raised spherical domed structure defined by one or more tangential radial segments.

3. The deformation resistant metal container as described in claim 1 wherein said metal container comprises a metal container selected from the group consisting of: a metal can, a beverage container, a preform, a bottle, a shaped metal container, an ironed metal container, a formed metal container, and/or a metal canister.

4. The deformation resistant metal container as described in claim 1 wherein said deformation energy comprises a deformation energy selected from the group consisting of: a deformation energy generated by fluid or gaseous pressurization of said container, a deformation energy generated by pasteurization of said container, drop energy, dome reversal displacement energy, and container growth energy.

5. The deformation resistant metal container as described in claim 1 wherein said initial deformation panel, and said buttressing structures, and said geometric panels, and said deformation panel boundary, and said inner conical leg angle are integrally coupled in a network.

6. The deformation resistant metal container as described in claim 5 wherein said network of buttressing structures positioned between a plurality of geometric panels comprises a plurality of opposing buttressing structures positioned between a plurality of geometric panels.

7. The deformation resistant metal container as described in claim 5 wherein said inner conical leg angle comprises an inner conical leg angle selected from the group consisting of: an inner conical leg angle having 2-10° degrees of taper, and an inner conical leg angle having 0-15° degrees of taper.

8. The deformation resistant metal container as described in claim 5 wherein said lightweight dome profile positioned at a terminal end of a metal container comprises a lightweight dome profile positioned at a terminal end of a metal container formed from a metal having at least a gauge less than that of a comparable metal container wherein said lightweight dome profile has at least equivalent deformation resistance as said metal comparable container.

9. The deformation resistant metal container as described in claim 5 wherein said lightweight dome profile positioned at a terminal end of a metal container comprises a lightweight dome profile positioned at a terminal end of a metal container having a dome depth 20-75% less than the dome depth for a comparable container.

10. A lightweight metal dome profile comprising:

at least one initial deformation panel wherein said initial deformation panel comprises an inwardly raised spherical domed structure having a deformation panel boundary defining the outer boundary of said initial deformation panel being positioned on an inner dome profile of a metal container and wherein said initial deformation panel is coupled with at least one geometric contoured shape at said deformation panel boundary;

wherein said at least one geometric contoured shape is configured to be capable of initiating a controlled sequential dome profile deformation in response to a deformation energy; and wherein movement of said initial deformation panel transfers said deformation energy onto said at least one geometric contoured shape generating a leveraged deformation displacement action that supports an inner conical leg angle of said lightweight dome profile.

11. The lightweight metal dome profile as described in claim 10 wherein said initial deformation panel comprises an inwardly raised spherical position defined by at least one spherical radii.

12. The lightweight metal dome profile as described in claim 10 wherein said geometric contoured shape configured to be capable of initiating a controlled sequential dome profile deformation in response to a deformation energy comprises one or more buttressing structures coupled with said initial deformation panel and configured to be capable of initiating a controlled sequential dome profile deformation in response to a deformation energy.

13. The lightweight metal dome profile as described in claim 12 wherein said controlled sequential dome profile deformation is initiated in response to the application of a deformation energy to said lightweight dome profile such that movement of said initial deformation panel transfers said deformation energy outwardly through said panel boundary onto one or more of said buttressing structures generating a leveraged deformation displacement action that supports said inner conical leg angle reinforcing the structural integrity of said lightweight dome profile.

14. The lightweight metal dome profile as described in claim 13 wherein said metal container comprises a metal container selected from the group consisting of: a metal can, a beverage container, a preform, a bottle, a shaped metal container, an ironed metal container, and a formed metal container.

15. The lightweight metal dome profile as described in claim 14 wherein said inner conical leg angle comprises an inner conical leg angle selected from the group consisting of: an inner conical leg angle having 2-10° degrees of taper, and an inner conical leg angle having 0-15° degrees of taper.

16. The lightweight metal dome profile as described in claim 14 wherein said lightweight dome profile comprises a lightweight dome profile formed from a metal having at least a gauge less than that of a comparable container wherein said lightweight metal dome profile has at least equivalent deformation resistance as said comparable container.

17. The lightweight metal dome profile as described in claim 14 wherein said lightweight dome profile comprises a lightweight dome profile having a dome depth 20-75% less than the dome depth for a comparable metal container.

18. A lightweight metal dome profile having a reduced pull down comprising:

a lightweight dome profile positioned at a terminal end of a metal container that is configured to be capable of a controlled sequential dome profile deformation;

wherein said lightweight dome profile further comprises:

at least one initial deformation panel wherein said initial deformation panel comprises an inwardly raised spherical domed structure positioned at a central position on an inner dome profile of said lightweight dome profile;

at least one buttressing structure coupled with said initial deformation panel at a deformation panel boundary;

a circumferentially positioned inner leg configured to have an inner conical leg angle coupled with said at least one buttressing structure and a plurality of geometric panels; and wherein the pulldown required to generate said lightweight dome profile configured to be capable of a controlled sequential dome profile deformation is 20-75% less than a comparable dome profile that is not configured to initiate said controlled sequential dome profile deformation.

19. The lightweight metal dome profile having a reduced pull down as described in 18 wherein said controlled sequential dome profile deformation is initiated in response to the application of a deformation energy to said lightweight dome profile such that movement of said initial deformation panel transfers said deformation energy outwardly onto said at least one buttressing structure generating a leveraged deformation displacement action that supports said inner conical leg angle reinforcing the structural integrity of said lightweight dome profile.

20. The lightweight metal dome profile having a reduced pull down as described in 19 wherein said initial deformation panel comprises an inwardly raised spherical position defined by at least one tangential radial segment.

21. The lightweight metal dome profile having a reduced pull down as described in 20 wherein said metal container comprises a metal container selected from the group consisting of: a metal can, a beverage container, a preform, a bottle, a shaped metal container, an ironed metal container, and a formed metal container.

22. The lightweight metal dome profile having a reduced pull down as described in 20 wherein said inner conical leg angle comprises an inner conical leg angle selected from the group consisting of: an inner conical leg angle having 2-10° degrees of taper, and an inner conical leg angle having 0-15° degrees of taper.

23. The lightweight metal dome profile having a reduced pull down as described in 20 wherein said lightweight dome profile comprises a lightweight dome profile formed from a metal having at least a gauge less than that of a comparable metal container wherein said lightweight dome profile has at least equivalent deformation resistance as said comparable metal container.

24. The deformation resistant metal dome profile comprising:

a lightweight dome profile positioned at a terminal end of a metal container that is configured to be capable of a controlled sequential dome profile deformation;

wherein said lightweight dome profile further comprises:

at least one initial deformation panel positioned at a central position on an inner dome profile of said lightweight dome profile;

a deformation panel boundary defining the outer boundary of said initial deformation panel;

at least one buttressing structure coupled with said initial deformation panel at said deformation panel boundary;

a circumferentially positioned inner leg configured to have an inner conical leg angle coupled with said at least one buttressing structure and a plurality of geometric panels; and wherein said controlled sequential dome profile deformation is initiated in response to the application of a deformation energy to said lightweight dome profile such that movement of said initial deformation panel transfers said deformation energy outwardly onto said at least one buttressing structures generating a staged leveraged deformation displacement action that delays deformation of said inner conical leg angle.

25. The deformation resistant metal dome profile as described in claim 24 wherein said staged leveraged deformation displacement action that delays deformation of said inner conical leg angle comprises a staged leveraged deformation displacement action that delays deformation progression of said inner conical leg angle to at least an inner conical leg angle prior to failure of said initial deformation panel resulting in deformation panel reversal.

26. The deformation resistant metal dome profile as described in claim 25 wherein said initial deformation panel comprises an inwardly raised spherical position defined by one or more tangential radial segments.

27. The deformation resistant metal dome profile as described in claim 26 wherein said inner conical leg angle comprises an inner conical leg angle selected from the group consisting of: an inner conical leg angle having 2-10° degrees of taper, and an inner conical leg angle having 0-15° degrees of taper.

28. The deformation resistant metal dome profile as described in claim 26 wherein said lightweight dome profile comprises a lightweight dome profile formed from a metal having at least a gauge less than that of a comparable metal container wherein said deformation resistant metal dome profile has at least equivalent deformation resistance as said comparable metal container.

29. The deformation resistant metal dome profile as described in claim 26 wherein said lightweight dome profile positioned at a terminal end of a metal container comprises a lightweight dome profile having a dome depth 20-75% less than the dome depth for a comparable metal container.

30. The deformation resistant metal dome profile as described in claim 25 wherein said staged leveraged deformation displacement action that delays deformation of said inner conical leg comprises the application of a deformation energy to said lightweight dome profile such that movement of said initial deformation panel transfers said deformation energy outwardly through said deformation panel boundary and onto at least one buttressing structure generating a leveraged deformation displacement action that supports said inner conical leg angle.

* * * * *